US006367760B1

(12) United States Patent
Pagano

(10) Patent No.: US 6,367,760 B1
(45) Date of Patent: Apr. 9, 2002

(54) CONVERTIBLE BOOK HOLDER

(76) Inventor: Samuel Pagano, 1632 Squaw Creek, Girard, OH (US) 44420

( * ) Notice: Subject to any disclaimer, the term of this patent is extended or adjusted under 35 U.S.C. 154(b) by 0 days.

(21) Appl. No.: 09/558,303

(22) Filed: Apr. 25, 2000

(51) Int. Cl.[7] ..... A47B 97/04
(52) U.S. Cl. ..... 248/451; 248/452
(58) Field of Search ..... 248/451, 452, 248/444.1, 446

(56) References Cited

U.S. PATENT DOCUMENTS

| | | | | | |
|---|---|---|---|---|---|
| 456,089 | A | * | 7/1891 | Harrison | 248/452 |
| 1,013,784 | A | * | 1/1912 | Kugel | 248/452 |
| 1,899,404 | A | | 2/1933 | White | |
| 2,156,225 | A | | 4/1939 | O'Meara | |
| 2,441,932 | A | | 5/1948 | Curry | |
| 4,116,414 | A | * | 9/1978 | Robertson | 248/451 |
| 4,275,863 | A | * | 6/1981 | Hartman | 248/448 |
| 4,416,414 | A | | 11/1983 | Edgerton | |
| 4,553,728 | A | * | 11/1985 | Corsello | 248/452 |
| 4,712,760 | A | | 12/1987 | Winter | |
| 5,052,650 | A | | 10/1991 | Beile et al. | |
| D327,172 | S | * | 6/1992 | Pagano | D6/312 |
| D366,568 | S | * | 1/1996 | Pagano | D6/310 |
| 5,620,162 | A | * | 4/1997 | Beckwith et al. | 248/442.2 |
| D381,212 | S | * | 7/1997 | Pagano | D6/300 |
| 5,855,329 | A | * | 1/1999 | Pagano | 248/451 |
| 5,893,546 | A | * | 4/1999 | Renfroe | 248/451 |
| 5,979,858 | A | * | 11/1999 | Bronson | 248/452 |
| 5,992,887 | A | * | 11/1999 | Maruchi | 281/42 |

* cited by examiner

*Primary Examiner*—Anita King
*Assistant Examiner*—Naschica S. Morrison
(74) *Attorney, Agent, or Firm*—Harpman & Harpman

(57) ABSTRACT

A convertible book holder for holding and positioning books and documents. The book holder includes a document support surface with a removable support and engagement clip interengaged with a portion of said document support surface.

5 Claims, 5 Drawing Sheets

CONVERTIBLE BOOK HOLDER

BACKGROUND OF THE INVENTION

1. Technical Field

This invention relates to book and copy holders used for holding and positioning material so they can be readily viewed by the user while performing other tasks. A book holder will typically support a book on a surface inclined from true vertical in an open configuration with book engagement means.

2. Description of Prior Art

Book and copy holders of this type have relied on a variety of useful constructions for supporting a book or papers in an upstanding position so that it can be easily read without holding same. Typically, a user would use both hands to support a book in an angled upright open position. This precludes or makes difficult for the user the use of their hands for writing or other like tasks. Alternately, books if hardback for example, can be propped up by leaning on some article and other non-rigid publication require more support such as workbooks used by teachers and students that are difficult to hold open and upright required for use. A number of different book and page holders have accordingly been developed to solve this problem.

Prior art holders of this type have a support frame or surface with attachment straps, hooks or clamps to hold the book on the stand and open or a single page to be copies, for instance. Examples of such devices can be seen in U.S. Pat. Nos. 1,899,404, 2,156,225, 2,441,932, 4,416,414, 4,712,760, and 5,052,650.

In U.S. Pat. No. 1,899,404 a book holder and table can be seen having a book support platform pivotally secured to an adjustable frame stand with a center engagement clip and a pair of adjustable leaf retainers.

U.S. Pat. No. 2,156,225 is directed to a reading stand having a wire support construction, a book engagement plate and multiple pivoted spring clips to hold the book open positioned within.

U.S. Pat. No. 2,441,932 shows an easel type support having a pair of criss-cross collapsible X-shaped support frame elements pivotally secured together with a resistance chain therebetween on an easel support. Page clips are removably secured to a central cross frame member.

Referring to U.S. Pat. No. 4,116,414, a book holder can be seen having a support sheet with a pivot stand leg. A pair of clothespins are resiliently secured to the support sheet engageable on a book position thereon.

U.S. Pat. No. 4,712,760 discloses a backrest with a page retainer having a tapered base with an insertable upstanding wall extending therefrom. Page retaining clips are adjustably positioned from the back for engagement thereover.

In U.S. Pat. No. 5,052,650 illustrates a copy holder having an upright flat surface supported by an adjustable stand with a line guide extending inwardly across the engagement surface from one side.

In applicant's own U.S. Pat. No. 5,855,329 a book holder is disclosed including a document support and display surface with oppositely disposed engagement clips extending from the support surface. An adjustable line guide is shown so as to be removably positioned from the support surface and can be advanced over the text of the book when in position.

SUMMARY OF THE INVENTION

A convertible book holder for supporting and displaying books, magazines and papers in an upright angled attitude.

The holder includes a mounting angular support base with an upstanding document support surface extending at right angles therefrom. A central support leg assembly is removably positioned on the document support surface having a top page return clip extending therefrom.

DESCRIPTION OF THE PREFERRED EMBODIMENT

Figure 1:
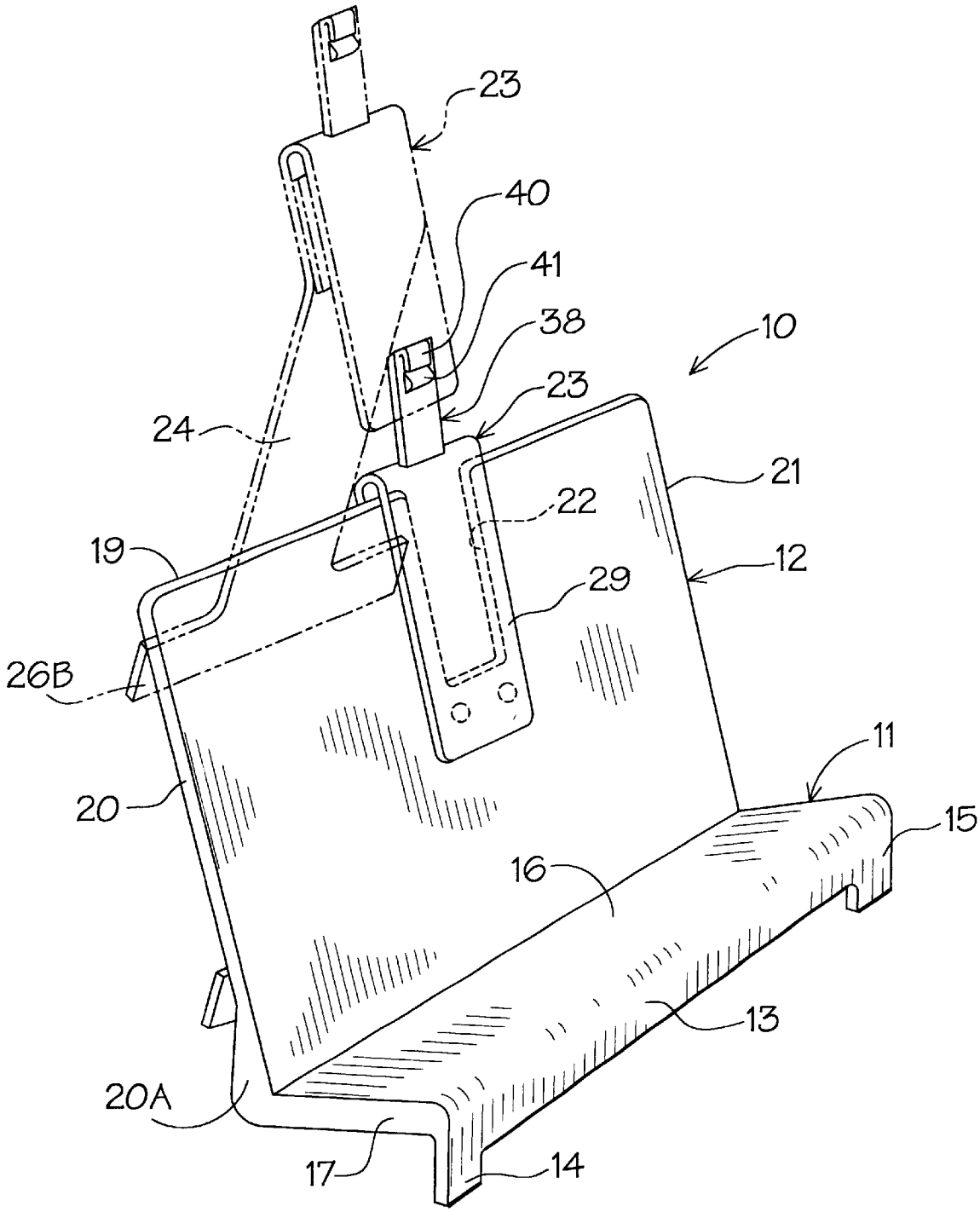
FIG. 1 is a perspective view of the book holder with the central support leg assembly shown in removable position in broken lines.
Figure 2:
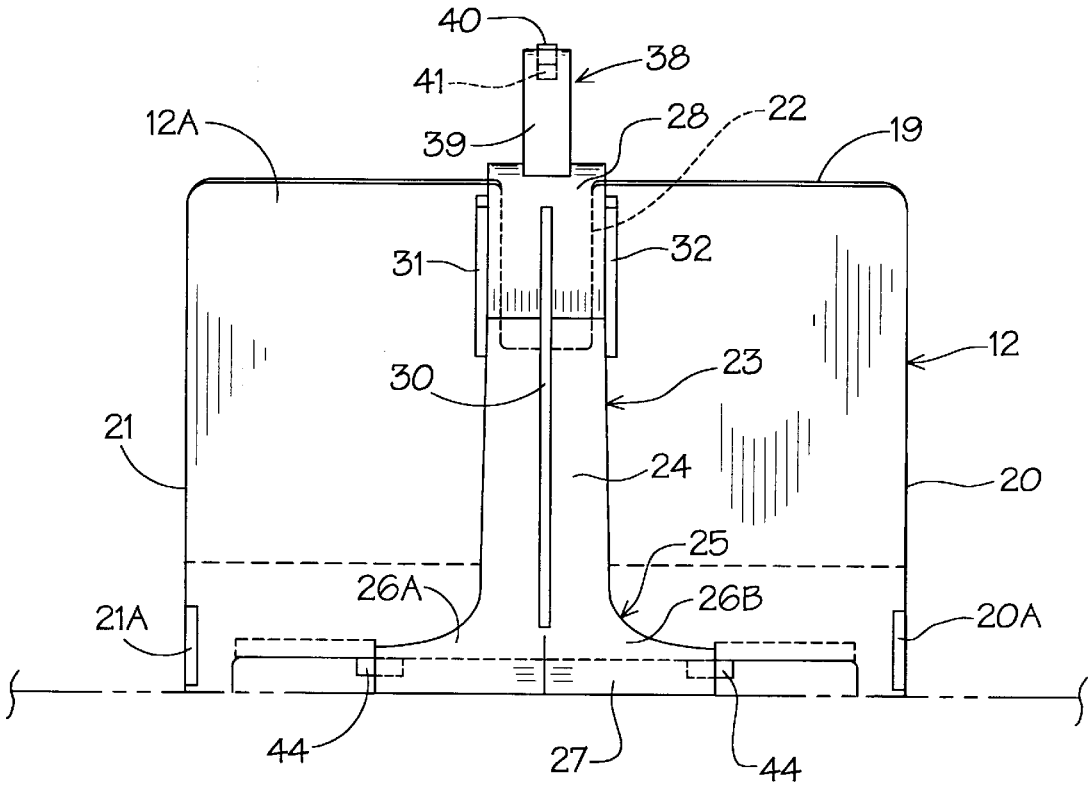
FIG. 2 is a rear elevational view of the book holder as shown in FIG. 1.
Figure 3:
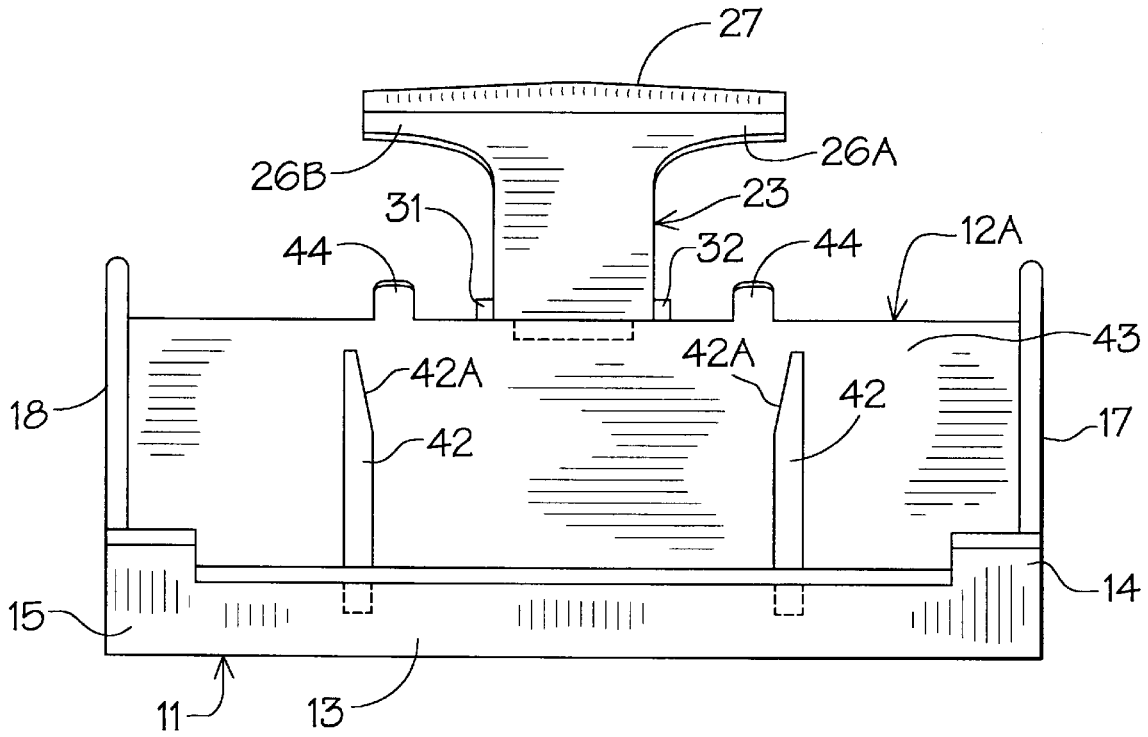
FIG. 3 is a bottom elevational view of the invention.
Figure 4:
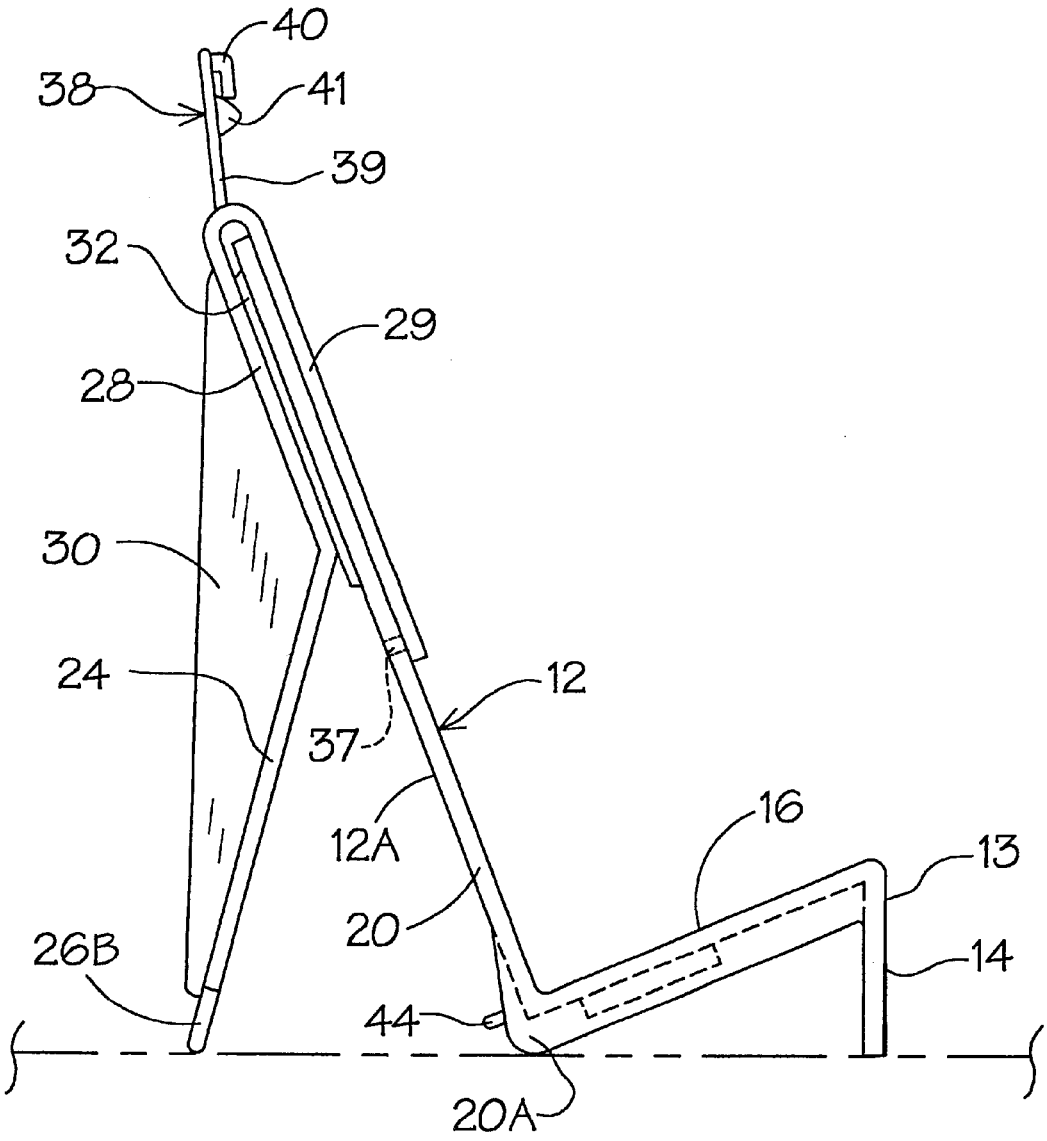
FIG. 4 is a side elevational view of the book holder as shown in FIG. 1.

Referring to FIGS. 1, 2, and 3 of the drawings, a book holder 10 of the invention can be seen having an elongated inclined base 11 with an upstanding support surface member 12 extending therefrom. The base 11 has a front surface 13 from which are formed a pair of oppositely disposed legs 14 and 15. An inclined upper surface 16 of the base 11 extends from the front surface 13 with integral sidewalls 17 and 18 respectively. The support surface member 12 extends from the upper surface 16 in spaced relation to the front surface 13 of the base 11. The support surface member 12 is at right angles to the inclined upper surface 16 and therefore is inclined from a true vertical. The support surface 12 is generally flat having a top edge 19 and respective side edges 20 and 21. Respective side edges 20 and 21 each have a tapered flange 20A and 21A extending therefrom adjacent the intersection between the support surface member 12 and the base 11. The flanges 20A and 21A extend and become integral with the hereinbefore-described sidewalls 17 and 18 as best seen in FIG. 4 of the drawings. The support surface 12 has an engagement notch at 22 inwardly from its top edge 19. A center support leg assembly 23 is respectively positioned within the notch at 22. The central support assembly 23 has a leg 24 with a base element 25 extending from its distal end. The base element 25 has a pair of oppositely disposed extensions 26A and 26B with an interconnecting surface element 27 therebetween. The leg 24 extends to an angular offset upper portion 28 having a return portion 29.

A rib web 30 extends from the leg 24 and angular offset portion 28 functioning as a leg reinforcement as will be well understood by those skilled in the art. A registration plate 33 is formed on the inner surface 34 of the offset portion 28. The registration plate 33 has a notched engagement portion 33A of a transferous dimension to be registerable within the notch 22 and a guide engagement portion 33B which is registerable between a pair of respective guide tracks 31 and 32 which are positioned on a back surface 12A of the support member 12 adjacent the notch at 22.

Figure 5:
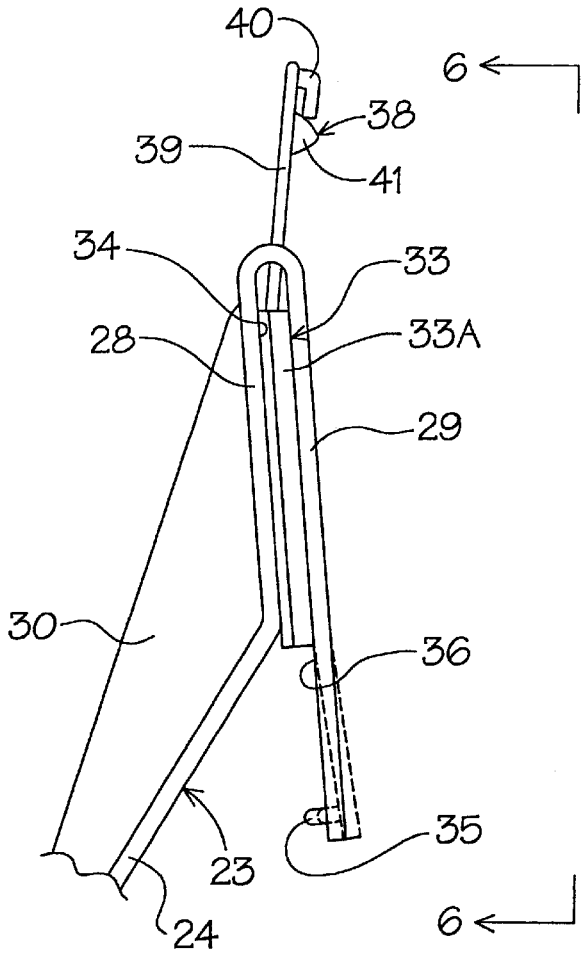
FIG. 5 is an enlarged partial side view of the engagement portion of the support leg assembly with portions broken away for illustration purposes.
Figure 6:
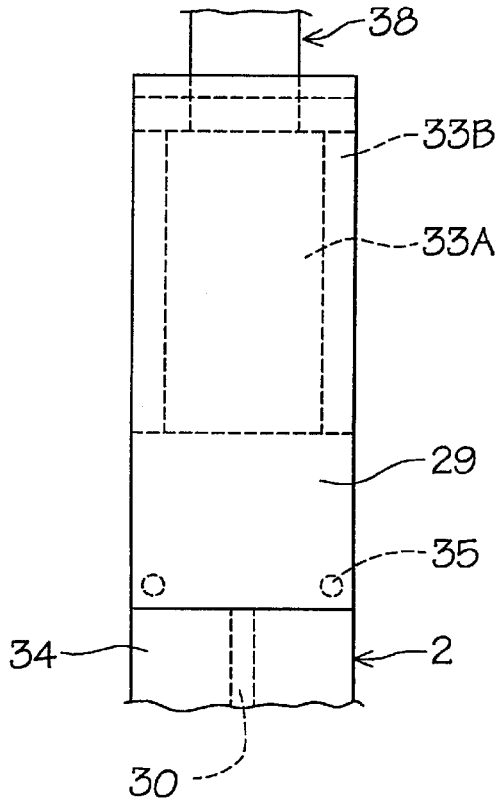
FIG. 6 is an enlarged front elevational view on lines 6—6 of FIG. 5.

The return portion 29 has a pair of spaced registration lugs 35 on its inner surface 36 inwardly of its distal end as best seen in FIGS. 4 and 5 of the drawings. The registration lugs 35 are aligned for engagement with respective apertures at 37 in the support surface 12 just below the notch at 22.

In use, the center support assembly 23 is slideably engaged over the top edge 19 with the registration plate 33 engaged within the notch at 22 and between the respective guide tracks 31 and 32 as hereinbefore described. As the support assembly 23 is advanced, the return portion 29 is flexed outwardly from the support surface 12 by the lugs 35 engagement thereagainst until locking alignment is achieved within the respective apertures at 37 as seen in solid lines in FIGS. 1, 2 and 4 of the drawings. A page-retaining clip 38 extends from the clip portion 30 of the central support assembly 23. The retaining clip 38 has an elongated cross-sectionally rectangular main body member 39 with an end return portion 40 and a paper engagement surface lug 41 in vertical spaced relation therebelow.

In use, the book holder 10 can receive and hold an open book (not shown) on its angled support surface 12 resting on the base 11. The center support assembly 23 can be removed from the engagement with the support surface 12 by deflecting the return portion 29 so as to disengage the respective locking lugs 35.

Referring now to FIGS. 2, 3 and 4 of the drawings, a pair of auxiliary mounting guide tracks 42 can be seen extending from the bottom surface 43 of the base 11. The respective tracks are tapered on their inner facing end surfaces 42A. A pair of spaced engagement tabs 44 extend from the back surface 12A of the support surface 12 coplanar with the bottom 43 surface of the base 11. The auxiliary mounting guide tracks 42 and engagement tabs 44 are provided for mounting the disassembled support surface 12 and base 11 onto a companion book holder (not shown).

It will be evident from the above referred to description that the book holder of the invention can be used as a stand alone unit as set forth in the specification or alternately disassembled with the surface support surface 12 and attached base 11 being engageable on a companion unit (not shown).

Additionally, it will be evident that by disassembling of the book holder 10 of the invention, the unit can be stacked upon itself for reduced shipping base as will be well understood by those skilled in the art.

It will therefore be seen that a new and useful convertible book holder has been illustrated and described and it will be apparent to those skilled in the art that various changes may be made therein without departing from the spirit of the invention.

Therefore I claim:

1. A book holder for supporting books and papers comprising: a base, a document support surface extending from said base, a leg support assembly registerably engageable within a notch in a portion of said document support surface, said leg assembly comprising a leg portion and an integrally angularly offset return portion, means for removably securing said return portion to said document support surface in spaced relation to said base, a page retaining clip extending from said return portion.

2. The book holder set forth in claim 1 wherein said base has a front surface, interconnecting integral side surfaces and an upper surface, said upper surface is angularly inclined from said front surface to said document support surface.

3. The book holder set forth in claim 1 wherein said document support surface is generally flat and wherein said registration notch extends inwardly from a top edge thereof oppositely disposed relation to said base.

4. The book holder set forth in claim 1 wherein said means for removably securing said return portion to said document support surface comprises a registration plate on an angular offset upper portion of said leg assembly registerable within said notch and locking lugs extending from said return portion of said leg assembly for registration in aligned apertures in said document support surface.

5. The book holder set forth in claim 4 wherein said return portion of said leg assembly is flexible.

* * * * *